United States Patent [19]

Sommer

[11] 4,082,485

[45] Apr. 4, 1978

[54] ROTARY VANE-TYPE PUMP

[75] Inventor: Manfred Sommer, Baden-Wurttemberg, Germany

[73] Assignee: Helmut Wolf, Germany

[21] Appl. No.: 748,226

[22] Filed: Dec. 7, 1976

[30] Foreign Application Priority Data

Dec. 8, 1975 Germany ..... 2555172

[51] Int. Cl.[2] ..... F04C 1/00

[52] U.S. Cl. ..... 418/226; 418/227

[58] Field of Search ..... 418/226, 227, 233

[56] References Cited

U.S. PATENT DOCUMENTS

| | | | |
|---|---|---|---|
| 120,548 | 10/1871 | Tate | 418/233 |
| 375,788 | 1/1888 | Williamson | 418/233 |
| 415,954 | 11/1889 | Williamson | 418/233 |
| 754,411 | 3/1904 | Berglund | 418/233 X |
| 889,426 | 6/1908 | Arons | 418/233 X |
| 1,560,804 | 11/1925 | Rosen | 418/233 |
| 2,557,427 | 6/1951 | Gibson | 418/233 |
| 3,895,893 | 7/1975 | Sommer | 418/226 X |
| 3,985,479 | 10/1976 | Sommer | 418/233 X |

*Primary Examiner*—Carlton R. Croyle

*Assistant Examiner*—Leonard E. Smith

*Attorney, Agent, or Firm*—Robert E. Burns; Emmanuel J. Lobato; Bruce L. Adams

[57] ABSTRACT

A rotary pump has a housing providing an annular passageway in which vanes carried by a rotor move in a circular path. The vanes are in the form of circular discs on the outer ends of radial shafts rotatably mounted in a hollow hub portion of the rotor. The annular passageway of the housing has a pumping portion of circular cross section with a diameter equal to that of the vanes and a sealing portion having a cross section corresponding to the cross section of the vanes. The angular orientation of the vanes is cyclically controlled so that the vanes are orthogonal to the passageway when in the pumping portion and are in line with the passageway when in the sealing portion. Control is effected by means of two separate rollers on an eccentric inner extension of each of the vane shafts. One roller engages a stationary annular cam coaxial with the rotor axis. A spring device comprising a helical compression spring in a telescopic casing presses on the second roller to keep the first roller in contact with the cam.

7 Claims, 3 Drawing Figures

E
2
33
462
24
471
470
474
920
422
435
472
236
d
238
423
60
d/2
421
298
927
265
302
308
242
296
935
45
301
309
485
295
241a
292
929
RA
290
241b
300
487
930
928
488
311
502
DA
932
503
284
303
283
265
241
307
306
RA
304
925
933
934
931
905
275
936
276
239
927
SA
240
37
930
236
487
r1
928
238
462
r2
435
2
936

ROTARY VANE-TYPE PUMP

FIELD OF INVENTION

The present invention relates to rotary pumps and in particular vane-type pumps of the kind shown in my U.S. Pat. No. 3,985,479 in which a plurality of vanes carryed by a rotor move in a circular path in an annular passageway in the pump housing and are cyclically orientated so as to be orthogonal to the passageway in a pumping portion and are in line with the passageway in a restricted sealing portion.

BACKGROUND OF INVENTION

In pumps of this kind there is a problem of controlling the vanes so that they are at all times properly oriented as they travel around the annular passageway in the housing. The construction of the above-mentioned patent and other constructions proposed by the inventor disclose different possibilities for carrying out the control of the vanes in pumps of this kind by means of cam tracks. The control of the vanes adjacent the sealing portion of the passageway presents the most difficult problem in such pumps particularly with regard to providing a practical and commercial pump which is suitable for special applications. The applicant has proposed arranging spring elements between two cam tracks which are movable wholely by themselves and with the help of additional rollers support the cam rollers. This arrangement is favorable with respect to energy requirements and is highly suitable for many applications. However when higher speeds are required the speed of the rollers of the spring elements of a suitable small size can reach unacceptable values for example 5,000 to 6,000 rpm with a rotor speed of about 1,000 rpm. Also the constantly moving spring elements can lead to unacceptable vibrations. On the whole spring pressed parts with a second guiding flank lead to the danger that all the vanes may be turned when it is desired to turn only one because of coarse substance in the pump between the vanes and the wall of the passageway.

SUMMARY OF INVENTION

It is an object of the present invention to avoid the above-mentioned disadvantages while retaining the advantages of previously known constructions and combining them with one another so as to attain the advantages set out below. The known and previously proposed constructions of the applicant in particular those of the above-mentioned patent are improved and further developed.

The invention deals with the problem of vane control by providing for a pump which is as simple as possible in construction and operation with high capacity small size and high suction which has a safe and easy mode of pumping and is insensitive to foreign bodies and coarse substances in the medium being pumped and in spite of this is quiet-running, a spring arrangement which even at high speeds of rotation of the rotor makes possible only limited vibration of the sliding or moving parts in the control mechanism.

In accordance with the invention there is provided a rotary pump comprising a housing defining an annular passageway and a rotor rotatably mounted in the housing coaxially with the passageway. The rotor comprises a central hollow hub portion and a plurality of vanes carried by the hub portion and disposed in the passageway of the housing for movement therein in a circular path. The vanes have the form of flat circular disks on the outer ends of shafts rotatable in the hub portion of the rotor about axes disposed radially of the axis of the rotor. The passageway of the housing has a pumping portion which is of circular cross section with a diameter equal to the diameter of the circular vanes and a sealing portion of a cross section corresponding to a diametrical cross section of the vanes with an inlet and an outlet at opposite ends of the sealing portion. Means for controlling rotary movement of the vanes to position them orthogonal to the passageway in the pumping portion and in line with the passageway in the sealing portion comprises an eccentric inward extension of each of the vane shafts. A cam follower on each of the eccentric shaft extensions is engageable with a stationary annular cam which is concentric with the axis of the rotor and has a single cam surface engageable with the cam follower on only one side thereof. The cam followers are resiliently urged toward the cam surface by biasing means comprising a bias applying element on the eccentric shaft portion separate from the cam follower and spring means acting between the bias applying element and a fixed seat portion of the rotor hub.

The cam follower is preferably a first roller which is rotatable on the eccentric shaft extension while the bias applying element is a second roller independently rotatable on the shaft extension. The spring means preferably comprises a helical compression spring in a telescopic casing comprising a fixed cylindrical portion which is fixed relative to the rotor with its axis parallel to the rotor axis and a movable cylindrical portion which is slidable in the fixed portion and bears against the second roller on the shaft extension under the action of the compression spring.

ADVANTAGES OF INVENTION

The spring pressure of the eccentric shaft extension on the cam roller which is rotatable on the shaft extension permits a rocking of the vanes when coarse material portions occur in the pump. As there is provided a control cam surface which is fixed with respect to the pump housing a precise control of the vanes is achieved. As the spring bears at one end on a part which is fixed relative to the rotor hub and at the other end on a spring element which is independent of the cam roller there is little tendency to develop undesired vibration or noise. Above all however there is only a limited movement between the offset portion and the spring supporting portion of the rotor hub because only the limited swinging movement of the offset shaft portion which determines eccentricity and stroke needs to be accommodated. The spring arrangement in accordance with the invention is thus suitable for high speed rotation of the rotor. The spring bias-applying element can for example be in the form of a connecting rod or a simple friction element. However, it is in the form of a roller which is separate from the cam roller and on which the spring device pushes. This can be of the same form and mounted in the same manner as the roller which runs on the cam surface. It hence has only rolling friction relative to the spring arrangement and indeed with very limited movement because the roller engaged by the spring device has only a small swinging movement on the offset shaft extension.

The arrangement of the springs in spring plungers provides a disturbance-free housing also in the event of breakage and provides a simple guidance as well as simplifying production and mounting. By corresponding construction and arrangement of the spring pressure receiving surfaces on the eccentric shaft extensions, a form which is particularly simple for production technique can be selected for the cylinders of the spring plungers and the bores in which they are received. In order to keep the support surfaces as small as possible so as not to impair the running of the adjacent cam rollers while accommodating a strong and positively acting spring, the spring roller engagement faces are preferably disposed on the free end faces of the spring plungers and may be hardened.

Unnecessarily great spring movement or corresponding rocking of the vanes can be avoided by suitable abutments, in particular when the abutments are somewhat elastic. These may be merely the end of the spring plunger and the bottom of the bore or a plastic piece may be interposed between them. The depth of the bore can be slightly greater than the maximum stroke when undesired swinging of the vanes is not to be limited by the spring plunger. With a greater number of vanes such undesired swinging on account of the close construction of the vanes and the cam rollers is not to be feared. When the possible depth of the bore is greater than the stroke, impact noises are avoided in normal running. While different springs can be used, helical compression springs are simple, economical and particularly well suited for the purpose and are available commercially for different types of pumps at an economical price.

The nature, objects and advantages of the invention will be more fully understood from the following description of a preferred embodiment shown by way of example in the drawings in which FIG. 1 is a section along the line 1—1 in FIG. 2 in which the section line is not straight but because of the offset axes of rotation is in part somewhat offset so as better to illustrate the vanes and journals, FIG. 2 is a section through the pump of FIG. 1 along the line 2—2 which as seen in FIG. 1 extends along separation plane E then is offset to the left in order to show the spring and in the lower portion of the pump returns to the plane E, and FIG. 3 is a fragmentary section.

DESCRIPTION OF PREFERRED EMBODIMENT

Figures 1, 3:
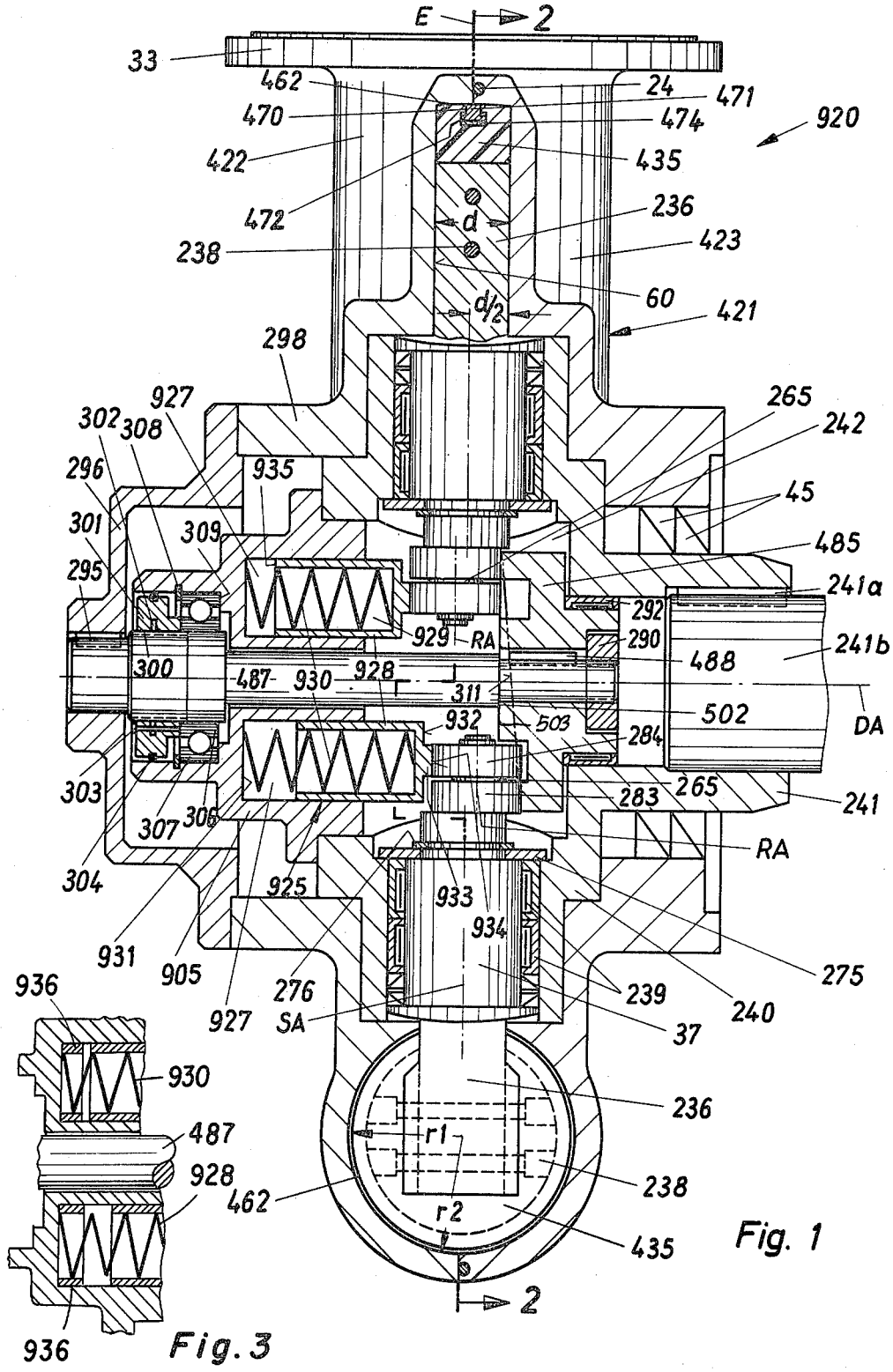

As shown by way of example in the drawings a pump 920 has a pump casing or housing 421 which is formed of two housing parts 422 and 423. These are divided along the main plane of rotation E and are joined with one another, with a packing ring 24 therebetween, for example by bolts extending through eyes 227 at the periphery of the housing.

In the pump housing 421 there is formed an annular channel or passageway 30 which as seen in FIG. 1 is of circular cross-section with a radius *r2*. Two branch passages 31 and 32 open tangentially in the passageway 30 and are provided with flanges 33 for connection with pipe lines. Although the pump can run in either direction the connection 31 will hereby considered to be the inlet or suction connection and the connection 32 will be considered as the outlet or pressure connection. They function in this manner when the pump rotor turns in a clockwise direction as indicated by the arrow 34 in FIG. 2.

Vanes 435 in the form of flat circular disks run in the annular channel 30. In the embodiment shown in the drawing there are four vanes which are uniformly spaced 90° from one another. The vanes 435 sit on supporting shafts 236 which extend outwardly from bearing shafts 37 into the vanes which are secured thereon by means of screws 238. The bearing shafts 37 are rotatable in needle bearings 239. They have pivot axes SA which lie in the main plane of rotation E and approximately radial to the axis of rotation DA of the pump. The needles bearing 239 sit in bores in a hub body 240 which is formed flange-like on a drive sleeve 241 and is hollow so as to leave free a control space or chamber 242 therein. The drive sleeve 241 is secured on the end of a drive shaft **241*b* by means of a key 241*a*. The hub body 240 is sealed in the pump housing 421 by shaft gaskets 45**. The bearing for the hub body is not shown in detail in the drawings. It can lie inside the housing or can be provided in the form of an external bearing block so that the bearing does not come into contact with the medium being pumped.

The annular channel 30 of the housing has a pumping portion 54 which extends from the inlet 31 to the outlet 32 and a sealing portion 55 which extends from the outlet 32 to the inlet 31 in the direction of rotation of the pump. In the pumping portion 54 the channel is of circular cross section so as to receive the vanes 435 in a position crosswise of the channel. In the sealing portion 55 the channel has a cross section corresponding to a diametrical cross section of the vanes with a thickness *d* so as to receive the vanes in edgewise position. For this purpose the housing parts 421 and 422 are formed as shown in the drawings with the sealing portion 55 correspondingly restricted. At the ends of the sealing portion 55 there are gently inclined ramp portions 259 at opposite sides of the channel so as to provide a funnel-like transition between the pumping portion and the sealing portion of the channel. In the sealing portion of the channel there are flat parallel sealing surfaces 60 which are spaced from the plane E by a distance having half the thickness $d/2$ of the vanes. The vanes 435 likewise have flat parallel pressure faces which pass exactly through sealing channel portion 55 so as to seal it.

The length of the sealing portion 55 of the channel between the outlet 32 and the inlet 31 corresponds to the spacing of the vanes - 90° in the illustrated embodiment - so that the entering vane completely seals the channel when the exiting vane leaves the sealing portion of the channel. There will of course be a portion of the medium being pumped between the vanes and this will be carried from the outlet to the inlet. In this respect the pump has a corresponding loss which can however be accepted in view of the otherwise desirable characteristics of the pump and the avoidance of pressure bodies in this area.

Figure 2:
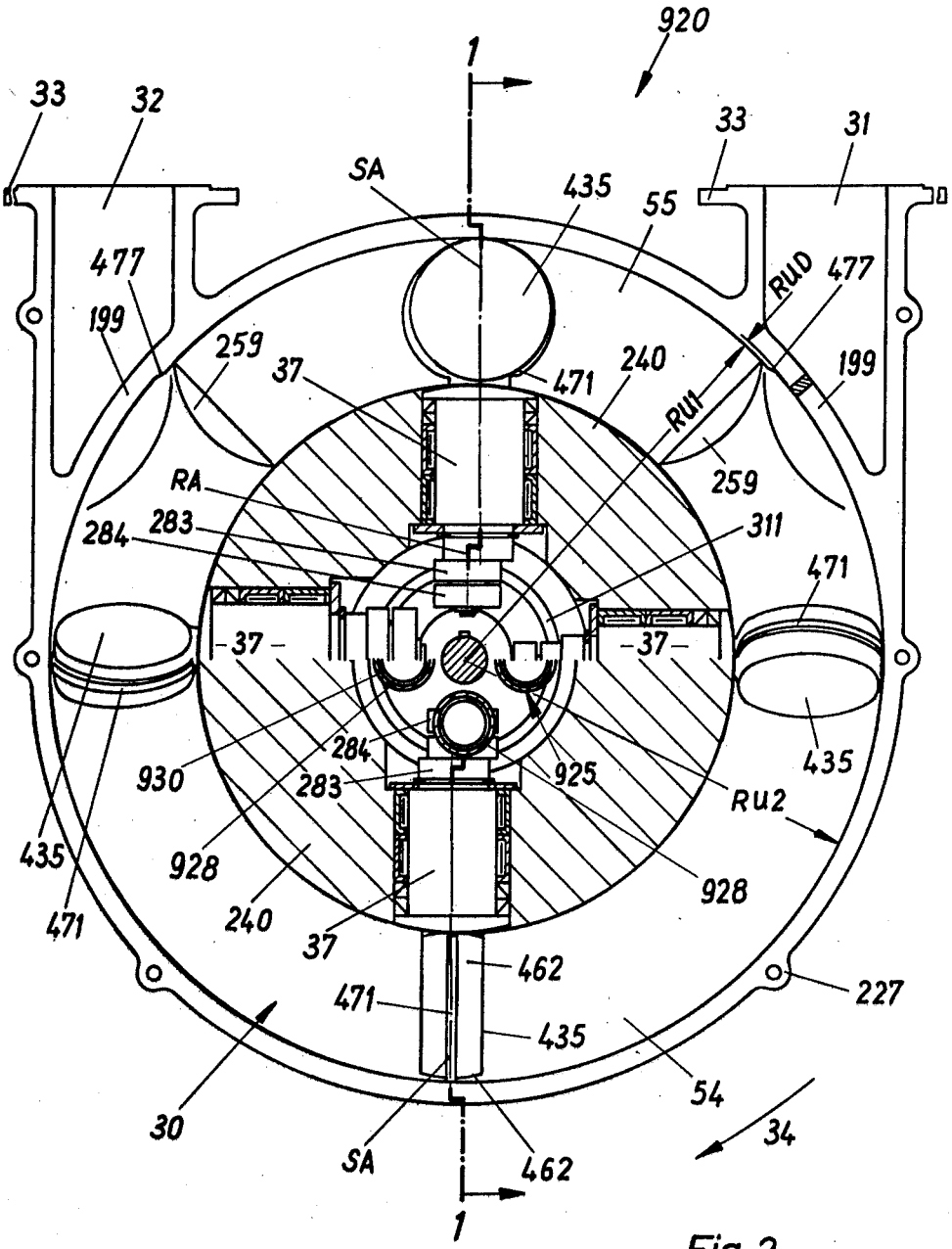

As will be seen in FIGS. 1 and 2, the circumferential surfaces 462 of the vanes are curved with a radius 41. They thus have a parti-spherical form in order to make possible good sealing and easy movement in all positions and to facilitate easy packing. In this circumferential surface 462 there is provided a groove 470 in which a sealing ring 471 is arranged as will be described more fully below. The sealing ring is formed of plastic or rubber material with good sealing, sliding and wearing characteristics with respect to the medium to be pumped. The sealing rings can also be in the form of stiff piston rings with insets of other material for example elastomeric material having good sliding and sealing characteristics. The vanes 435 which as a rule are interchangeable parts can according to the medium to be pumped be formed from steel, primarily stainless steel. However the vanes can be formed of polyamide or similar plastic material especially when the pump is to be used for media with especially unfavorable constituents.

As the rotor of the pump comprising the hub portion 240 rotates, the vanes 435 must be cyclically controlled so as to be orthogonal to the channel in the pump housing in the pumping portion and edgewise in the sealing portion. For the control, which in contrast to many embodiments of the above-mentioned patent is arranged wholely outside the pump chamber proper, the bearing shafts 37 extend into the control chamber 242 inside the hub body. They are secured against radial movement by a washer 275 and a lock ring 276. At their inner ends they carry offset shaft portions 275 which are of reduced diameter and are arranged eccentrically with respect to the pivot axis SA of the vanes 435. Each of the eccentric shaft portions 265 carries two rollers 283 and 284 which are of the same size and are rotatably mounted on the eccentric shaft portion 265 for example by means of needle bearings so as to be independently rotatable about the axis RA of the eccentric shaft portion.

The relative position of each of the eccentric shaft portions 265 to the vane 435 is so selected that a plane connecting the pivot axis SA of the vane and the roller axis RA of the eccentric shaft portion is disposed at an angle of 45° to the mid-plane of the vane so that when the vane is orthogonal to its direction of movement in the channel of the housing the plane connecting the axes SA and RA is inclined in the direction of the main control surface 311 of a stationary annular cam which is engaged by the rollers 283. The pivot axes SA of the vanes lie in the plane of rotation E and are parallel to but slightly offset from radii RU which pass through the axis of rotation DA and likewise lie in the plane of rotation E so that the roller axis RA in both end positions of the vane movement lie approximately in a radial plane passing through the axis of rotation DA.

For the swinging of the vanes 35 there is provided an annular cam 485. It is fixed on an axle 487 for example by means of a key or wedge 488. The cam 485 is mounted on the axle 487 by means of a nut 290. It lies in a recess inside the hub body 240 and a reduced cylindrical portion of the cam is rotationally guided in the sleeve 241 by a needle bearing 292. The axle 487 is held against rotation by a key 295 but is axially movable in a hat-shaped cover 296 on the housing. The cover is secured on a collar 298 of the housing portion 422 by means of screws. Inside the hat-shaped cover 296 there is provided an arrangement for axial adjustment of the axle 487. The axle has a threaded portion 300 on which an adjusting nut 301 is screwed. This has an inner clamping slit 302 and a set screw 303. A packing ring 304 provides a seal between the nut 301 and a bearing cup 905 of the rotor. The adjusting nut 301 bears on the inner ring 306 of a roller bearing which is capable of taking axial thrust and for example is a grooved ball-bearing that however is arranged slidably with adequate play on the axle 487. The outer ring 307 of the bearing is held fast against a shoulder 309 of the hub by a lock ring 308. By turning the adjusting nut 301 the axial position of the axle 487 and hence of the cam 485 relative to the axes of the vane shafts 37 can be adjusted.

It will thus be seen that the cam 485 secured on the axle 487 by the nut 290 cannot rotate relative to the pump housing 421 but is axially adjustable relative to the positions of the vane shafts 37. The cam 485 is provided with the main cam surface 311 and with a supporting surface 503 which abuts an offset 502 on the axle 487.

The cam track consists of four sections. A first section corresponding to the pumping portion 54 of the channel and extending almost three-quarters of the circumference lies in a plane which is perpendicular to the axis of rotation DA. A second section parallel to the first but offset thereto corresponds to the sealing portion 55 of the channel and extends approximately for one-fourth of the circumference. The other two are transition sections on which the cam rollers rise or fall and thereby turn the vanes from one end position to the other.

Only the rollers 283 engage the cam surface 311 of the cam portion 485. In order that the rollers 284 can run freely, the cam portion 485 is so formed that the cam face 311 has only the width of the rollers 283. Radially inwardly of the cam face 311 the cam portion 485 is recessed so that it cannot engage the rollers 284.

In order to press the rollers 283 against the cam surface 311 a spring mechanism 925 is provided for each of the vanes. For this purpose four cylindrical spring receiving recesses 927 which are parallel to the axis of rotation DA are formed for example as bores in a bearing cap 905 which is fixed with respect to the hub body 241. In each of these bores a likewise cylindrical spring plunger 928 is axially slidable. These have inner sockets 929 which receive helical compression springs 930 that act between the bottom of the socket 929 and the spring supporting surface formed by the bottom 931 of the bores 927. The outer diameter of the helical compression springs 930 corresponds to the diameter of the socket 929 so that the springs 930 are satisfactorily guided even when the spring plungers 928 are in their outermost position. On the inner ends 932 of the spring plungers there are provided lugs 933 the end faces of which engage the rollers 284 which for identification are referred to as spring rollers.

In FIG. 1 the end positions of the rollers are shown. The difference between the position of the rollers shown above and below the axis of rotation DA represents the stroke of the rollers and hence of the spring plungers 928. It will be seen that when the rollers are fully displaced toward the left as illustrated in the upper portion of FIG. 1 the spring plunger 928 is not fully received in the bore 927 but its inner end 935 is spaced from the spring supporting surface 931 at the bottom of the bore so that in normal pump operation there is no danger of the spring plunger striking the bottom of the bore. It follows that the maximum penetration of the spring plunger 928 in the bore is greater than the maximum stroke of the rollers 283 and 284. However if desired insert collars preferably of elastic material can be provided between the inner ends 935 of the spring plungers and the spring supporting surface 931 of the bore so as to limit the stroke of the rollers for example in high speed operation while at the same time avoiding impact and noise by reason of the elastic nature of the material. Also such inserts can be provided so that the swinging of the vanes is limited to 90° and hence the vanes cannot reverse. As the pumps are frequently constructed with more than four vanes and other constructive measures are provided to avoid reversal it is not necessary in all instances to limit the stroke of the spring plungers.

It will be seen that the spring roller engaging faces 934 of the spring plungers engage only the rollers 284 while the rollers 283 are free to rotate. As the rollers 283 and 284 are independently rotatable on the same eccentric shaft portions 265 the springs 930 act through these spring plungers and rollers 284 to press the rollers 283 against the cam surface 311 but leave the rollers 283 free to roll on the cam surface. The spring rollers 284 have only a small swinging movement. The springs 930 are selected according to desired spring characteristics and are interchangeable so that for different speeds of rotation and for pumping dififferent media which may contain different sizes of particles the springs can be changed and suited for the particular conditions of operation.

The vanes 435 and the channel 54 of the housing have slightly different dimensions. The circumferential surfaces 462 of the vanes 435 have a radius *r*1 while the channel cross section has a slightly different, for example 1 mm. to 3 mm. larger radius *r*2. Accordingly the pumping channel 54 has a slightly greater outer radius RU2 measured from the axis of rotation DA. This slight difference is selected in order to permit the sealing rings 471 of the vanes to work satisfactorily. As the pump is designed for media which contains large pieces and also impurities the vanes are provided with moveable sealing rings 471 in the nature of piston rings. The rings 471 are of T-shaped in cross section. The stem is very small. The sealing ring 471 is formed of plastic material which is relatively hard yet somewhat elastic; for example, a high strength polyamide or similar material. Polytetrafluoroethylene is particularly suitable. In the circumference of each of the vanes 435 there is a corresponding groove 470 of T-shaped cross section. The vanes 435 are preferably also made of plastic material for example polyamide and after they are placed on the relatively wide shaft extensions 236 they are secured by screws 238. The T-groove 470 is sufficiently deep that an elastic element can be inserted under the sealing ring 471. This can be formed in any way. In particular it is desired to use an elastic spring strip 474 formed of elastomeric material having for example a hardness of 60 Shore C. All of the vanes 435 are provided with T-grooves 470, sealing rings 471 and spring strips 474. These are pressed into the grooves 470 from outside. That is possible becuase the vanes and the sealing rings are formed of elastic material and the stems 472 are small. The spring strips 474 constantly press the sealing rings 471 outwardly so that they effectively engage the channel walls to provide a satisfactory seal.

If the sealing portion 55 of the channel were to have a large outer radius RU2 corresponding to that of the pumping portion of the channel and the sealing rings 471 were pressed outwardly as described above, there would be a considerable space on both sides of the sealing ring so that a satisfactory seal between the inlet and the outlet of the pump would not be obtained. In this part of the housing a corresponding groove could be provided to receive the sealing ring. However with this construction there would be the danger that the sides of the sealing ring would be badly abraded. It is hence preferable as illustrated in FIG. 2 to make the outer radius RU1 of the sealing portion 55 of the channel slightly smaller than the outer radius RU2 of the pumping portion. The difference is equal to the difference between the radii *r*1 and *r*2 of the vanes as seen in FIG. 1. In the vicinity of the inlet and outlet there are transition portions 477 between the smaller radius RU1 and larger radius RU2. By reason of the smaller outside radius of the sealing portion of the channel the circumferential surfaces 462 of the vanes 435 exactly engage the outer surface of the sealing portion 55 of the channel so as to provide an effective seal. The springs 474 permits the sealing ring 471 to be pushed inwardly at the outer portion of the vane so as to be approximately flush with the peripheral surface 462. With this construction there is achieved effective sealing both in the pumping portion and in the sealing portion of the channel.

At the inlet and outlet there are small bars 199 on both sides of the dividing plane E which extend across the openings and hold back large particles of material so that they will not be clamped between the vanes 435 and the wall of the channel. The cross section of these bars is illustrated by a cross hatched portion in FIG. 2.

OPERATION

When the pump is driven by the shaft 241*b*, the hub body 241 and vanes 435 are rotated in the housing. If the direction of rotation is clockwise as indicated by the arrow 34 in FIG. 2 the vanes 435 leaving the sealing channel portion 55 are turned so as to be crosswise of the channel because the corresponding rollers 283 run over the transition portion of the cam surface 311 to a lower level. The swinging is effected by the force of the spring 930. Thus the vanes in the region of the inlet 31 are turned to a position in which they are perpendicular to the plane of rotation E. It thereby closes off the volume of the channel portion in front of it and behind the preceding vane. The volume portion thus closed off is moved around the pumping portion 54 of the channel until the preceding vane 435 reaches the outlet whereupon the preceding vane is turned to a position to enter the sealing portion 55 of the channel by engagement of the corresponding roller 283 with the transition portion of the cam surface 311 and is thereby raised to a higher level. The eccentric shaft portion 265 is thereby swung about the axis SA so as to turn the shaft 37 and thereby turn the vane 435 so that its side faces are parallel to the plane of rotation E and the vane is thereby positioned to enter the sealing portion 55 of the channel. When the vane has fully entered the channel it closes the channel completely. The volume of fluid being pushed forward by the following vane is thereupon discharged through the outlet except for a portion which enters the sealing portion of the channel behind the preceding vane. As one vane enters the sealing portion of the channel the preceding vane exits at the other end of the sealing portion and begins the above described cycle anew. As the rotor rotates, the springs 930 are alternately compressed and expanded so as to keep the rollers 283 in engagement with the cam surface 311.

In the event that the medium being pumped contains large pieces which hinder the free springing of the vanes the corresponding vanes outside the sealing portion are free to yield to such interference by reason of the springs 930 which are accordingly compressed. After the interfering pieces of material have been cleared, the springs 930 swing the vanes back to the desired position in which they are perpendicular to the plane of rotation E.

Through the individual spring biasing of the vanes each vane can turn independently of the others. As the springs do not act on the rollers which engage the control cam these rollers are free to turn so as to roll freely on the cam surface. As the spring devices rotate with the hub portion of the rotor the spring rollers 284 need have only a small angle of turning. The spring bias automatically compensates for small unevenness in the cam track so as to permit the rollers to run smoothly and quietly.

While a preferred embodiment of the invention has been illustrated by way of example in the drawings it will be understood that many modifications are possible. For example as illustrated in FIG. 3 short sleeves 936 are inserted in the bores 927 between the spring supporting surfaces 931 and the spring plungers 928 so as to limit movement of the spring plungers and thereby limit swinging movement of the vanes. The sleeves 936 are formed of suitable nonmetallic material for example plastic or elastomeric material and are of such length as to limit swinging of the vanes as desired. If desired the springs for biasing the rollers 283 toward the cam track can act through other elements for example through connecting rods. Instead of the spring plungers acting on rollers 284 they may press on friction surfaces provided on the eccentric shaft extensions 265. Also the bias on the rollers 283 can be provided by a spring element in the form of U-shaped bows when it is necessary to save space in the interior of the rotor hub. Instead of needle bearings and thrust disks for the vane shafts 37 the shafts may be supported by other bearings capable of taking axial thrust for example grooved ball-bearings. Still other modifications will occur to persons skilled in the art. Hence the invention is in no way limited to the illustrated embodiment.

What I claim is:

1. A rotary pump comprising a housing defining an annular passageway and a rotor rotatably mounted in said housing coaxially with said passageway, said rotor comprising a central hollow hub portion and a plurality of vanes carried by the hub portion and disposed in said passageway for movement therein in a circular path, said vanes having the form of flat circular discs on the outer ends of shafts rotatable in said hub portion about axes disposed radially of the axis of said rotor, said passageway of said housing having a pumping portion which is of circular cross section with a diameter equal to the diameter of said circular vanes and a sealing portion of a cross section corresponding to a dimetrical cross section of said vanes with an inlet and an outlet respectively at opposite ends of said sealing portion and means for controlling rotary movement of said shafts to position said vanes orthogonally to said passageway in the pumping portion thereof and in line with said passageway in the sealing portion thereof, said control means comprising an eccentric inward extension of each of said shafts, a cam follower on each of said eccentric shaft extensions, a stationary annular cam concentric with the axis of said rotor and having a single cam surface engageable with said cam follower on one side only thereof and biasing means for urging said cam follower against said cam surface, said biasing means for each vane comprising a bias applying element on said eccentric shaft portion separate from said cam follower and spring means acting between said bias applying element and a fixed seat portion of said hub.

2. A rotary pump according to claim 1, in which said cam follower is a first roller rotatable on said eccentric shaft portion and said bias applying element is a second roller independently rotatable on said eccentric shaft portion.

3. A rotary pump according to claim 1, in which said spring means comprises a helical compression spring in a telescopic casing.

4. A rotary pump according to claim 3, comprising nonmetallic resilient abutment means in said casing limiting movement of said cam follower and thereby limiting rotary movement of said vane shafts and the vanes on the outer ends thereof.

5. A rotary pump according to claim 3, in which said spring casing comprises a fixed cylindrical portion which is fixed relative to said rotor with its axis parallel to the axis of the rotor and a movably cylindrical portion slidable in said fixed portion and bearing on said bias applying element, said spring acting between said fixed and movable portions.

6. A rotary means according to claim 5, in which said first portion comprises a cylindrical bore in said hub portion of the rotor.

7. A rotary pump according to claim 6, in which said bore has a bottom on which said spring seats and is of such depth that said movable cylindrical portion is spaced from said bottom when in position of maximum normal entry into said bore.

* * * * *